US005190222A

United States Patent [19]

Haruch

[11] Patent Number: 5,190,222

[45] Date of Patent: Mar. 2, 1993

[54] SPRAY NOZZLE WITH RECESSED DEFLECTOR SURFACE

[75] Inventor: James Haruch, Naperville, Ill.

[73] Assignee: Spraying Systems Co., Wheaton, Ill.

[21] Appl. No.: 715,438

[22] Filed: Jun. 14, 1991

[51] Int. Cl.[5] ..... B05B 1/26

[52] U.S. Cl. ..... 239/523; 239/524; 239/550; 239/DIG. 1

[58] Field of Search ..... 239/432, 434, 510, 512, 239/523, 524, 553.3, DIG. 1, 565, 550, 499

[56] References Cited

U.S. PATENT DOCUMENTS

| | | | |
|---|---|---|---|
| 2,864,652 | 12/1958 | O'Brien et al. | 239/524 |
| 3,082,961 | 3/1963 | Hruby, Jr. | 239/523 |
| 3,085,754 | 4/1963 | Thompson | 239/523 |
| 4,185,781 | 1/1980 | O'Brien | 239/600 |
| 4,353,508 | 10/1982 | Butterfield et al. | 239/590.3 |
| 4,356,974 | 11/1982 | Rosenberg et al. | 239/524 |
| 4,815,665 | 3/1989 | Haruch | 239/432 |
| 4,828,182 | 5/1989 | Haruch | 239/432 |
| 4,899,937 | 2/1990 | Haruch | 239/432 |

*Primary Examiner*—Andres Kashnikow

*Assistant Examiner*—Karen B. Merritt

*Attorney, Agent, or Firm*—Leydig, Voit & Mayer

[57] ABSTRACT

A spray nozzle assembly having a spray tip formed with an elongated, axially extending cylindrical chamber communicating with the liquid supply and being formed with a cross slot which intersects the chamber at a location intermediate the ends thereof for defining a discharge orifice, a deflection surface on a downstream side of the discharge orifice for directing liquid in a direction transversed to the axis of the chamber, and a pocket extending downstream of the deflector surface a distance significantly greater than the diameter of the chamber. In one embodiment, the spray tip has a pre-orifice of about one half the diameter of the chamber adjacent an upstream in thereof, in another embodiement, the chamber is disposed with it axis at an angle to the vertical and the cross slot extends upwardly in substantially vertical relation for defining a vertical deflection surface, and in still another embodiment the cross slot is formed with a round that extends beyond the axis of the chamber substantially to the perimeter thereof and has a radius of about twice the diameter of the chamber.

31 Claims, 4 Drawing Sheets

SPRAY NOZZLE WITH RECESSED DEFLECTOR SURFACE

FIELD OF THE INVENTION

The present invention relates generally to spray nozzles, and more particularly, to spray nozzle assemblies of the type which have a spray tip with a transversely oriented deflector flange formed with a distinct recess or pocket for the purpose of effecting a particular desired liquid distribution in the discharging spray.

BACKGROUND OF THE INVENTION

Spray nozzle assemblies are known, such as shown in U.S. Pat. No. 4,899,937 assigned to the same assignee as the present invention, which include a deflector flange that enhances particle breakdown and directs the spray pattern in a transverse direction. The deflector flange of the nozzle shown in the aforesaid U.S. Patent is formed with a distinct recess or pocket in axial alignment with the liquid discharge orifice in the nozzle tip, which has been found to generate a spray pattern that has shallow bell-shaped liquid distribution curve with greatest quantities of liquid being directed in a central portion of the spray pattern and lesser quantities on opposite sides thereof so that overlapping spray patterns from a plurality of such nozzles mounted in laterally spaced relation to each other, such as on the boom on an agricultural sprayer, produce a substantially uniform distribution of liquid over the area being sprayed.

In hydraulic spraying applications, namely applications in which the liquid flow stream is not subject to air-assisted pre-atomization, such nozzles have been found to be susceptible to excessive wear that can alter the spray characteristics and substantially increase the liquid flow. Although wear is reduced if the liquid is pre-atomized by pressurized air prior to direction through the nozzle spray tip, such air assisted spraying generates a fog-like discharge of relatively fine liquid particles. In agricultural applications, unless such discharging spray is directed in a substantially straight downward direction, the fine liquid particles are subject to undesirable drift. Heretofore, it often has not been possible to easily mount such spray nozzles for straight downwardly directed spraying, particularly on booms which are adapted for vertical spray nozzle mounting. Since the deflector flange of the nozzle is disposed transversely to the discharge orifice, such nozzles also have been susceptible to clogging by solid materials that might be included in the liquid being sprayed.

OBJECTS AND SUMMARY OF THE INVENTION

It is an object of the present invention to provide a spray nozzle assembly with a spray tip having a recessed deflector flange that may be utilized for hydraulic spray applications to generate a controlled shallow bell-shaped liquid distribution with less susceptibility to wear.

Another object provides a spray nozzle assembly as characterized above which can be easily mounted on an agricultural spray boom for directing the discharging spray in a substantially straight downward direction, without tedious adjustment or manipulation of the nozzle during mounting.

A further object is to provide a spray nozzle assembly of the above kind that is adapted for spraying solids containing liquids with less tendency for clogging.

Other objects and advantages of the invention will become apparent upon reading the following detailed description and upon reference to the drawings, in which:

Figure 1:
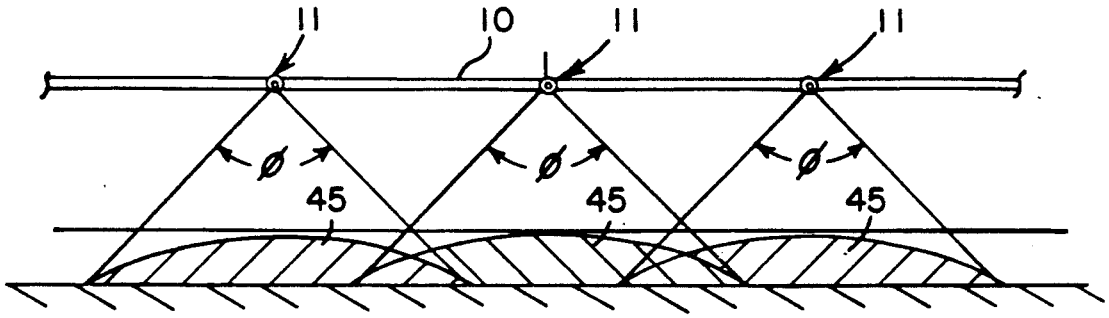
FIG. 1 is a partially diagrammatic depiction of the performance of a plurality of nozzles assemblies embodying the present invention mounted in laterally spaced relation to each other on a spray boom, with the liquid distribution curve of each nozzle assembly depicted below the respective nozzle assembly.

While the invention is susceptible of various modifications in alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalence falling within the spirit and scope of the invention.

DESCRIPTION OF THE PREFERRED EMBODIMENTS

Figure 2:
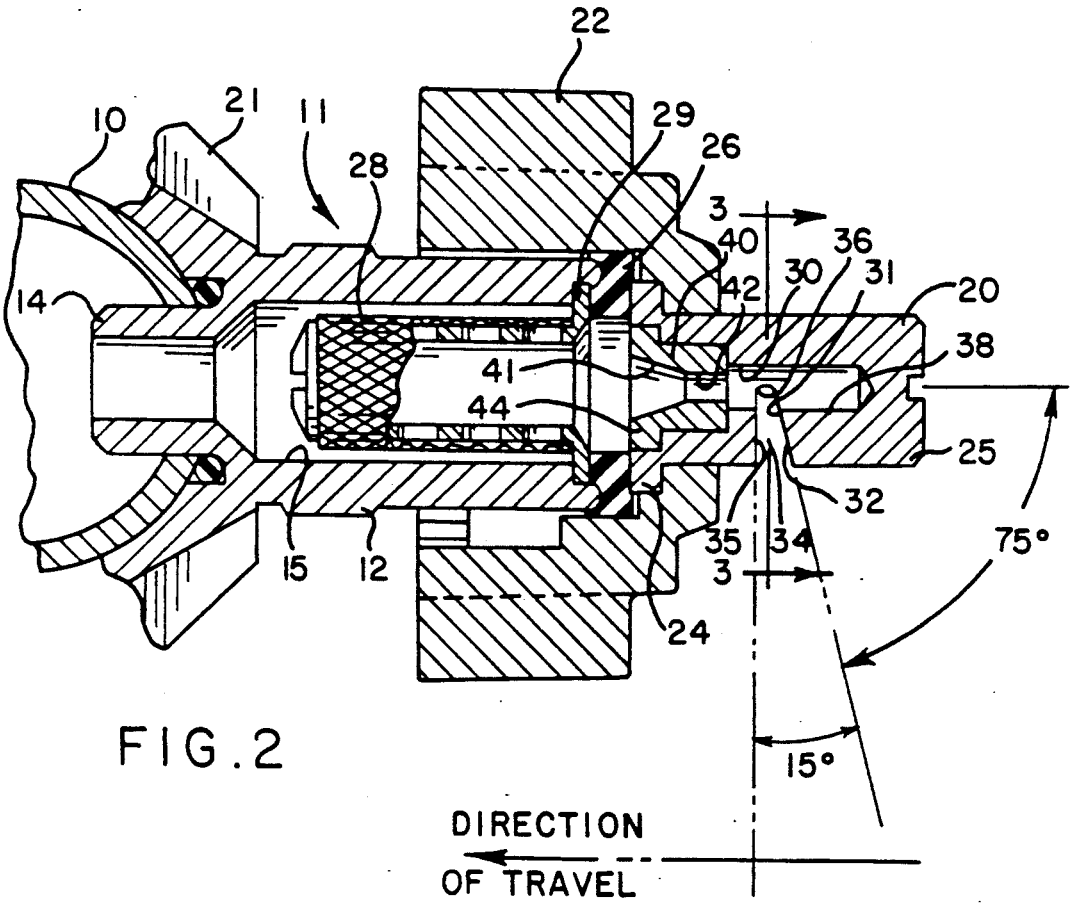
FIG. 2 is an enlarged fragmentary section of one of the spray nozzle assemblies.
Figure 3:
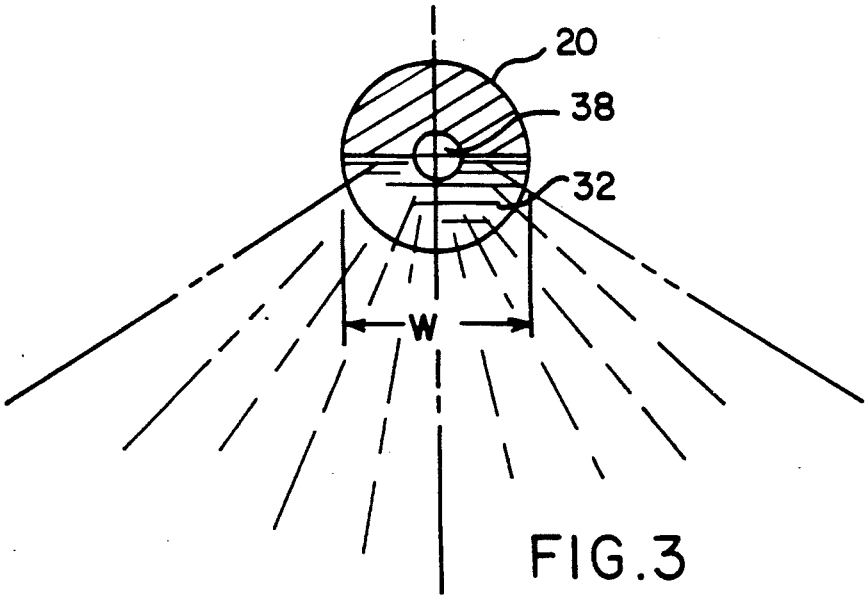
FIG. 3 is an enlarged vertical section of the spray tip of the nozzle assembly shown in FIG. 2, taken in the plane of 3—3.

Referring now more particularly to FIGS. 1–3 of the drawings, there is shown a spray boom 10, such as the boom of an agricultural sprayer, having mounted thereon a plurality of spray nozzle assemblies 11 in accordance with the invention. The boom 10 in this instance is a tubular member through which the supply liquid is directed. Each spray nozzle assembly 11 includes a stem 12 having a nipple 14 extending into the boom 10 through an aperture in one side thereof. Pressurized liquid supplied to the boom 10 enters the stem 12 through the nipple 14 and passes through a central fluid passageway 15 in the stem 12 for direction through and discharge from a spray tip 20 mounted at the outer end thereof. The stem 12 is secured to the boom 10 by appropriate means, such as a clamp 21.

For removably securing the spray tip 20 to the stem 12, a retention cap 22 is provided, which may be of the type disclosed in Butterfield et al. U.S. Pat. No. 4,527,745. The spray tip 20 has an outwardly extending flange 24 at its upstream end, seated in the cap 22 and a body portion 25 extending outwardly of the cap 22 through a central aperture therein. The retention cap 22 in turn is telescoped over the outer end of the stem 12. For locking the cap 22 and spray tip 20 in predetermined position on the stem 12, the stem 12 and cap 22 may be formed with cooperative locking lugs and slots as is known in the art. A resilient annular gasket 26 is interposed between the end of the spray tip mounting flange 24 and the end of the stem 12, and a strainer 28 is secured within the flow passageway 15 of the stem 12 with a mounting flange 29 thereof interposed between the resilient gasket 26 and a seat formed in the end of the stem 12. Liquid directed through the stem 12 passes through the strainer 28 prior to its direction through the spray tip 20.

The spray tip 20 is formed with an elongated chamber 30 that extends into the body 25 from an upstream end thereof for communication with the liquid passageway 15 in the stem 12. For defining a discharge orifice 31 and a deflection surface or face 32 for directing liquid in a downward direction transverse to the longitudinal axis of the stem 12 and spray tip 20, the spray tip 20 is formed with a cross slot 34 extending upwardly from and underside thereof. The cross slot 34 in this case defines a generally vertically directed upstream face 35 with the downstream deflection face 32 being oriented at an angle of about 15 degrees with respect to the vertical. The apex between the cross slot faces 32, 35 is connected by a round 36 preferably extending to the longitudinal axis of the spray tip chamber 30, which has been found to define a spray pattern with a relatively wide angle $\phi$ between about 120 and 130 degrees (FIG. 1) that is particularly desirable for agricultural spraying. Extending the cross slot 34 upwardly beyond the longitudinal axis of the chamber 30 has been effective for increasing the angle $\phi$ of the discharging spray pattern up to and approaching 180 degrees.

For enhancing liquid breakdown and atomization and for directing a discharging spray pattern with a shallow bell-shaped liquid distribution curve, the cross slot 34 intersects the chamber 30 intermediate the ends thereof for defining a significant recess or pocket 38 downstream of the discharge orifice 31 and deflector surface 32. The recess or pocket 38 extends beyond the deflector surface 32 a distance of at least twice, and preferably about 3 times the diameter of the chamber 30. While spray nozzles with recessed deflector flanges, such as shown in U.S. Pat. No. 4,899,937, have been found effective for generating sprays with bell-shaped liquid distribution curves, as previously indicated, when used in hydraulic, non-air-assisted spraying applications, such tips have been found to experience significant wear about the discharge orifice and deflector surface. As a result, use of such nozzles have been largely limited to air assisted spray applications in which a pre-atomized liquid flow stream is directed through the spray tip.

In accordance with the invention, the nozzle spray tip defines a pre-orifice upstream of the discharge orifice which is sized substantially smaller than the nozzle tip chamber such that the chamber and the deflector surface recess form an expansion chamber that facilitates breakdown and direction of the liquid particles with significantly reduced wear, while not substantially affecting the bell-shaped character of the liquid distribution of the discharging spray. To this end, in the illustrated embodiment, the spray tip 20 includes a pre-orifice member 40 that is press fit or otherwise secured in the upstream end of the spray tip 20. The pre-orifice member 40 is formed with an inwardly tapered entrance passageway or throat 41 for receiving supply liquid from the flow passageway 15 of the stem 12 and which communicates with a cylindrical pre-orifice 42 having a diameter preferably on the order of about ½ the diameter of the spray tip chamber 30 for throttling and accelerating liquid into the expansion chamber defined by the spray tip chamber 30 and deflector surface recess 38. The pre-orifice member 40 in this case has an outwardly extending, annular flange 44 at its upstream end received in a counterbore formed in the spray tip 20 for locating the upstream face of the pre-orifice member 40 flush with the upstream face of the nozzle tip 20. The discharge orifice 31 preferably has an area greater than the area of the pre-orifice 42 for insuring the free passage of the liquid entering the chamber 30.

In operation, supply liquid from the boom 10 is directed to the spray tip 20 via the stem passageway 15. Liquid entering the spray tip 20 is accelerated as is passes through the pre-orifice 42 into the expansion chamber defined by the chamber 30 and deflector surface recess 38, where the liquid is broken down and mixed with significant turbulence. Liquid particles generated within the chamber 30 are directed through the discharge orifice 31 and along the deflector surface 32 where they are broken down further for ultimate direction in a fan-shaped spray pattern having a relatively wide angle $\phi$ of between about 120–130 degrees, as illustrated in FIG. 1. As further depicted in FIG. 1, the discharging spray generates a shallow or flat bell-shaped liquid distribution curve 45, with lesser quantities of liquid being generated at opposite sides of the spray pattern, thereby enabling the discharging sprays of adjacent nozzles to be directed for slight overlap with the resulting liquid distribution across the area sprayed being substantially uniform for optimum application of agricultural chemicals and the like. The pre-orifice member 40 has been found to significantly minimize wear to the discharge orifice 31 and deflector surface 32 of the spray tip 30, and the downwardly directed discharge orifice 31 of the spray tip enables the nozzle assembly to be used for agricultural applications in both for hydraulic and air-assisted spraying modes.

Figure 4:
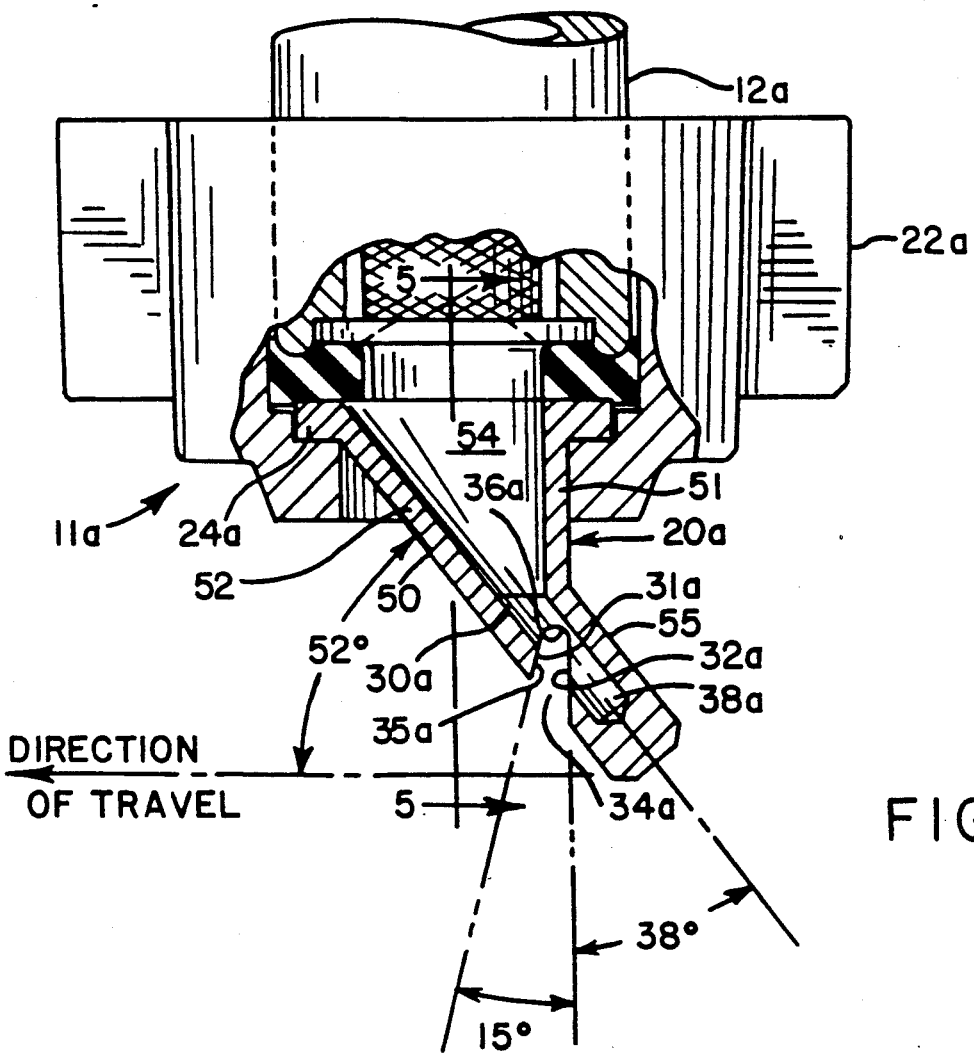
FIG. 4 is a side elevational view, in partial section, illustrating an alternative embodiment of spray nozzle assembly according to the present invention, mounted in vertically depending relation from a horizontal spray boom.
Figure 5:
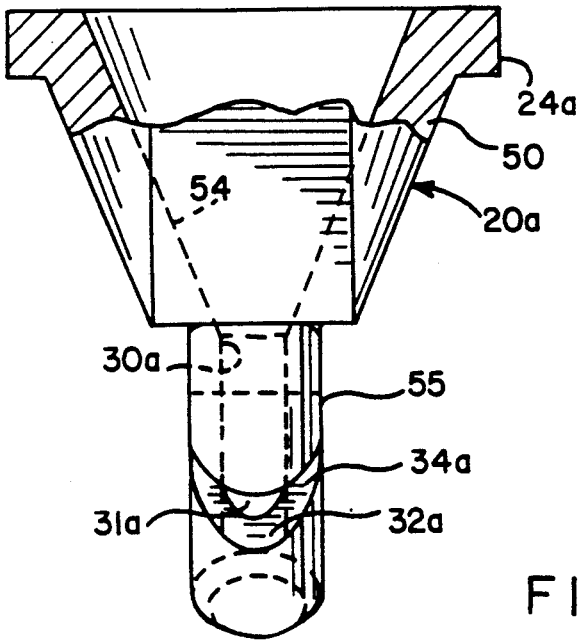
FIG. 5 is an enlarged side elevational view, in partial section, of the spray tip included in the nozzle assembly of shown in FIG. 4.

Referring now to FIGS. 4 and 5, there is shown an alternative spray nozzle assembly **11*a* in accordance with the invention that is adapted for producing a downwardly directed spray, while being mounted on a vertical stem 12*a* of a conventional horizontal spray boom. Items similar to those described above have been given similar reference numerals with the distinguishing suffix "a" added. The nozzle assembly 11*a* in this case includes a spray tip 20*a* which again has an outwardly extending mounting flange 24*a* at its upstream end to facilitate releasable securement to the stem 12*a* by a retention cap 22*a*. The spray tip 20*a* has an upper portion 50 formed by a cylindrical wall 51 on one side thereof co-axial with the stem 12*a* and a side wall 52 which extends in skewed or angular relation to the longitudinal axis of the stem, which together define an entry chamber 54 that extends downwardly and to one side, as shown in FIG. 4. The spray tip 20*a* has a cylindrical extension 55 directed downwardly and an angle to the vertical axis as an extension of the skewed side wall 52. The cylindrical spray tip extension 55 is formed with a chamber 30*a* that communicates at its upper end with the tapered entry chamber 54**.

In carrying out the invention, the spray tip extension 55 is formed with an upwardly directed, substantially vertically oriented cross slot 34a which defines a discharge orifice 31a for the spray tip 20a and a deflection surface 32a for directing a discharging liquid spray in a substantially downward direction. The cross slot 34a has a "V" configuration with the downstream deflection surface 32a defined thereby being substantially vertically oriented and an upstream side or face 35a thereof disposed at an angle of about 15 degrees rearwardly of to the vertical. The upper end or apex of the cross slot 34a is in the form of a round 36a that extends substantially to the upper perimeter of the chamber 30a such that the discharge orifice 31a has a cross sectional area greater than the cross sectional area of the chamber 30a for minimizing clogging and wear about the discharge orifice 31a and deflector surface 32a, while generating a discharging spray with a spray angle of between about 120 and 130 degrees. For enhancing liquid breakdown and generation of a shallow a bell-shaped liquid distribution curve, as indicated in the previous embodiment, the cross slot 34a is located upstream of the end of the chamber 30a so as to define a distinct pocket or recess 38a extending downstream of the deflector surface 32a.

Figure 6:
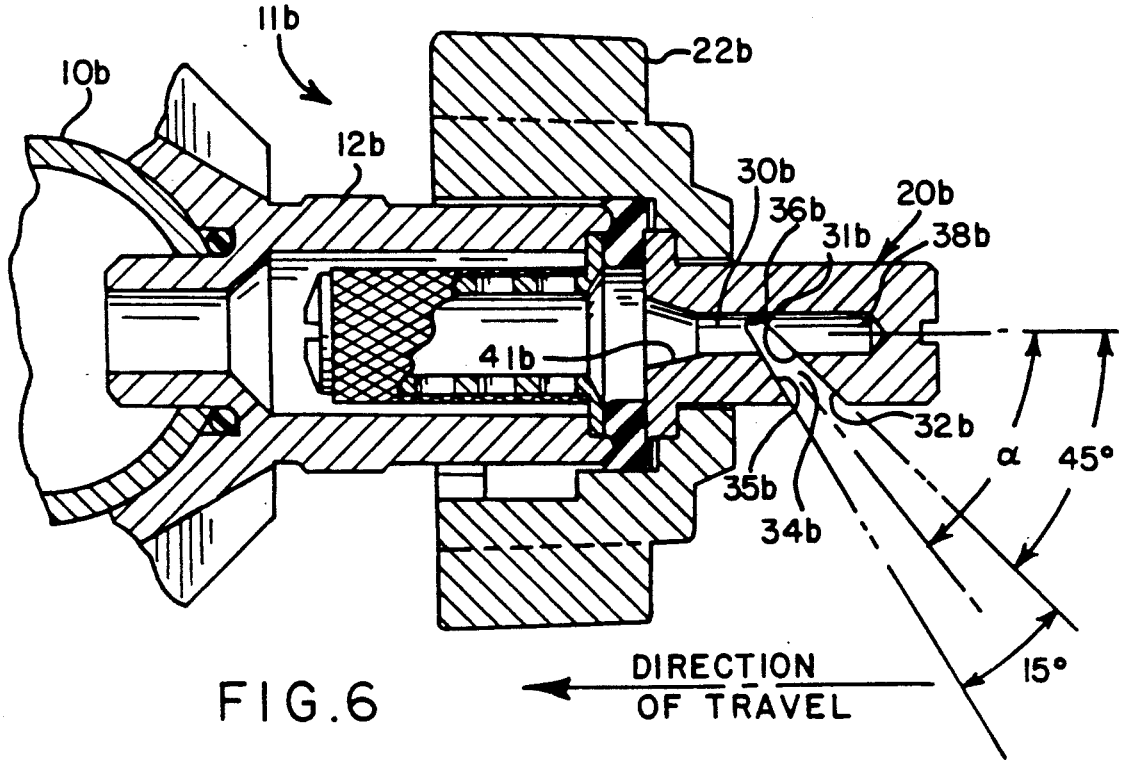
FIG. 6 is a vertical section of another embodiment of spray nozzle assembly according to the present invention.

Referring now to FIG. 6, there is shown another alternative embodiment of spray nozzle assembly 11b wherein items similar to those described above have been given similar reference numerals with the distinguishing suffice "b" added. The nozzle assembly 11b in this case includes a spray tip 20b mounted on a stem 12b extending horizontally from the liquid supply boom 10b. The spray tip 20b is formed with tapered entry throat 41b which communicates with an axial chamber 30b. The discharge orifice 31b in this case is defined by a cross slot 34b formed in the underside of the spray tip 20 at acute angle $\phi$ of about 52½ degrees to the axis of the spray tip 20b and the horizontal. The cross slot 34b defines a downstream deflection surface 32b and an upstream surface 35b disposed at an angle of about 15 degrees to each other, resulting in the deflection surface being oriented at an angle of 45 degrees to the axis of the spray tip. The apex of the cross slot is formed with a round 36b in this instance extending above the axis of the spray tip chamber to about the upper perimeter thereof for causing the discharge orifice 31b to have an area greater than the area defined by the diameter of the chamber 30 for preventing clogging and wear in the vicinity of the cross slot 34b and the deflector surface 32b. The cross slot 34a again intersects the chamber 30b at a location intermediate its ends for defining a distinct recess or pocket 38b on the downstream side of the deflector surface 32b. With the spray tip 30b horizontally mounted, as illustrated in FIG. 6, the discharging spray pattern is directed in a downward and forward direction, again with a shallow bell-shaped liquid distribution curve similar to that previously described.

Figure 7:
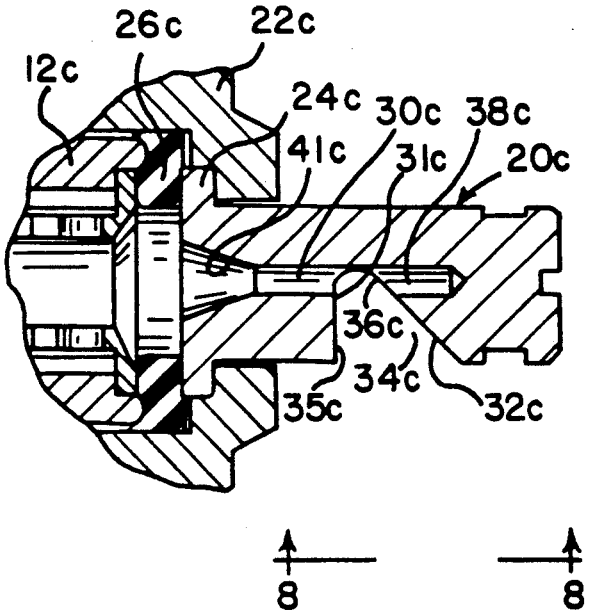
FIG. 7 is a vertical section of still another alternative embodiment of nozzle assembly according to the present invention.
Figure 8:
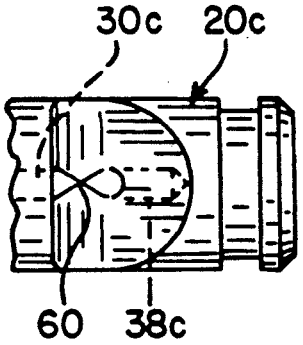
FIG. 8 is a bottom view of the spray tip included in the nozzle assembly shown in FIG. 7.

Referring now to FIGS. 7 and 8, there is shown still another alternative embodiment of spray nozzle assembly according to the present invention wherein items similar to those described above have been given similar reference numerals with the distinguishing suffix "c" added. The spray tip 20c again has a mounting flange 24c for securement to a horizontal stem of a spray boom. The spray tip 20c is formed with an inwardly tapered entry throat 41c communicating with an axial chamber 30c. A cross slot 34c in the underside of the spray tip defines a discharge orifice 31c, a downstream deflection surface 32c in this instance disposed at an angle of about 45 degrees to the horizontal, and a vertical upstream face 35c. The upstream and downstream faces 35c, 32c defined by the cross slot 34c have an apex in the form of a round 36c that extends about to the upper perimeter of the chamber 30c intermediate the ends thereof for defining a recess or pocket 38c downstream of the deflection surface 32c. In the event that the spray tip 20c is machined from metal stock, the depth of the cross slot 34 can be easily determined by the machine operator by viewing the point of tangency 60 of the cross slot 34 with the upper perimeter of the chamber 30, as shown in FIG. 8. The round 36c in this instance has a radius which is about the about twice the diameter of the chamber 30c for defining a discharge orifice 31c with significantly greater area than the diameter of the chamber for permittinq free passage of solids containing liquids and for minimizing wear in the area of the discharge orifice and deflection surface, while at the same time generating a relatively wide angle spray pattern with a shallow bell-shaped liquid distribution curve substantially similar to that previously described.

From the foregoing it can be seen that the spray nozzle assembly of the present invention is particularly adaptable for spraying agricultural chemicals with a substantially uniform liquid distribution over the area being sprayed. The nozzle assembly may be used in both purely hydraulic and air-assisted spray applications, and in the latter case, is easily adaptable for directing discharging sprays in a substantially straight downward direction. The nozzle is less susceptible to undesirable wear and clogging.

I claim:

1. A spray nozzle assembly for mounting on a spray boom through which a supply liquid is directed comprising, a stem mounted on said boom and having a liquid passage for receiving supply liquid from said boom, a spray tip, means for mounting said spray tip on said stem for receiving supply liquid from said stem passage and for directing the liquid in a pre-determined spray pattern, said spray tip being formed with an elongated, axially extending cylindrical chamber communicating with said stem passage, and said spray tip being formed with a cross slot which intersects said chamber at a location intermediate opposite ends thereof for defining a discharge orifice, a deflection surface on a downstream side of said discharge orifice for directing liquid discharging from said orifice in a direction transverse to the axis of said chamber, and a pocket extending downstream of said deflection surface a distance at least twice the diameter of said chamber.

2. The spray nozzle assembly of claim 1 in which said discharge orifice has an area greater than the cross sectional area of said chamber.

3. The spray nozzle assembly of claim 1 in which said stem and spray tip are mounted in horizontally extending relation to said boom, and said cross slot is formed on an underside of said spray tip.

4. A spray nozzle assembly for mounting on a spray boom through which a supply liquid is directed comprising, a stem mounted on said boom and having a liquid passage for receiving supply liquid from said boom, a spray tip;

means for mounting said spray tip on said stem for receiving supply liquid from said stem passage and for directing the liquid in a pre-determined spray pattern, said spray tip being formed with an elongated, axially extending cylindrical chamber communicating with said stem passage, said spray tip having a metering orifice adjacent an upstream side of said chamber that is substantially smaller in diameter than the diameter of said chamber, and said spray tip being formed with a cross slot which intersects said chamber at a location intermediate opposite ends thereof for defining a discharge orifice, a deflection surface on a downstream side of said discharge orifice for directing liquid discharging from said orifice in a direction transverse to the axis of said chamber, and a pocket extending downstream of said deflection surface a distance greater than the diameter of said chamber.

5. The spray nozzle assembly of claim 4 in which said metering orifice is about one half the diameter of said chamber.

6. A spray nozzle assembly for mounting on a spray boom through which a supply liquid is directed comprising, a stem mounted on said boom and having a liquid passage for receiving supply liquid from said boom, a spray tip, means for mounting said spray tip on said stem for receiving supply liquid from said stem passage and for directing the liquid in a pre-determined spray pattern, said spray tip being formed with an elongated, axially extending cylindrical chamber communicating with said stem passage, and said spray tip being formed with a cross slot which intersects said chamber at a location intermediate opposite ends thereof for defining a discharge orifice, a deflection surface on a downstream side of said discharge orifice for directing liquid discharging from said orifice in a direction transverse to the axis of said chamber, a second surface upstream of said deflection surface, and a pocket extending downstream of said deflection surface a distance greater than the diameter of said chamber, said spray tip having a metering orifice adjacent an upstream side of said chamber that is substantially smaller in diameter than the diameter of said chamber, and said deflection and upstream surfaces being connected by a round that extends at least to the axis of said chamber for defining a spray pattern that extends outwardly at an angle of between about 120 and 130 degrees.

7. The spray nozzle assembly of claim 6 in which said round has a radius greater than the diameter of said chamber.

8. The spray nozzle assembly of claim 7 in which said round has a radius of about twice the diameter of said chamber.

9. The spray nozzle assembly of claim 6 in which said deflection and upstream surfaces are disposed at an angle of about 15 degrees to each other, and said deflection surface is disposed at an angle of about 45 degrees to the axis of said chamber.

10. A spray nozzle assembly comprising, a stem means defining a passage through which a supply liquid is directed, a spray tip, means for mounting said spray tip on said stem, means for receiving supply liquid from said passage and for directing the liquid in a pre-determined spray pattern, said spray tip being formed with an elongated, axially extending cylindrical chamber communicating with said passage, and said spray tip being formed with a cross slot which intersects said chamber at a location intermediate opposite ends thereof for defining a discharge orifice, a deflection surface on a downstream side of said discharge orifice for directing liquid discharging from said orifice in a direction transverse to the axis of said chamber, and a pocket extending downstream of said deflection surface, and said spray tip having a metering orifice adjacent an upstream side of said chamber which is about one half the diameter of said chamber.

11. The spray nozzle assembly of claim 10 in which said metering orifice is defined by a separate pre-orifice member mounted in an upstream end of said spray tip.

12. The spray nozzle assembly of claim 10 in which said cross slot extends at least to the axis of said chamber.

13. The spray nozzle assembly of claim 12 in which said cross slot defines an upstream surface disposed substantially perpendicularly to the axis of said chamber, and said deflection surface being disposed at an angle of about 15 degrees to said upstream surface.

14. A spray nozzle assembly comprising, vertically disposed stem means having a liquid passage through which a supply liquid is directed, a spray tip, means for mounting said spray tip on a lower end of said stem means for receiving supply liquid from said liquid passage, said spray tip being formed with an elongated, cylindrical chamber communicating with said stem means passage and having an axis disposed at an acute angle to the vertical, and said spray tip being formed with a substantially vertically oriented cross slot on the underside thereof which intersects said chamber at a location intermediate opposite ends thereof for defining a discharge orifice, a deflection surface on a downstream side of said discharge orifice for directing liquid discharging from said orifice in a downward direction, and a pocket extending downstream of said deflection surface.

15. The spray nozzle assembly of claim 14 in which said deflection surface is substantially vertically disposed.

16. The spray nozzle assembly of claim 15 in which said cross slot defines a second surface disposed at an angle of about 15 degrees to said deflection surface.

17. The spray nozzle assembly of claim 14 in which said cross slot extends beyond the axis of said chamber substantially to an upper perimeter thereof for defining a discharge orifice having an area at least as large as the cross sectional area of said chamber for permitting the free passage of liquid introduced into said chamber.

18. A spray nozzle assembly comprising, vertically disposed stem means having a liquid passage through which a supply liquid is directed, a spray tip, means for mounting said spray tip on a lower end of said stem means for receiving supply liquid from said liquid passage, said spray tip being formed with an elongated, cylindrical chamber communicating with said stem means passage and having an axis disposed at an angle to the vertical, said spray tip being formed with a substantially vertically oriented cross slot on the underside thereof which intersects said chamber at a location intermediate opposite ends thereof for defining a discharge orifice, a deflection surface on a downstream side of said discharge orifice for directing liquid discharging from said orifice in a downward direction, and a pocket extending downstream of said deflection surface, and said spray tip having an upper portion formed by a vertically disposed cylindrical side wall on one side thereof and a side wall on the opposite side thereof extending in skewed relation to the vertical, said side walls defining a tapered entry chamber communicating between said stem means passage and said cylindrical chamber.

19. The spray nozzle assembly of claim 18 in which said spray tip has a cylindrical extension directed downwardly at an angle to the vertical axis as an extension of said skewed side wall, and said cylindrical chamber being formed within said spray tip extension.

20. A spray nozzle assembly comprising, a stem means through which a supply liquid is directed, a spray tip, means for mounting said spray tip on said stem means for receiving supply liquid from said passage and for directing the liquid in a pre-determined spray pattern, said spray tip being formed with an elongated, axially extending cylindrical chamber communicating with said passage, said spray tip being formed with a cross slot which intersects said chamber at a location intermediate opposite ends thereof for defining a discharge orifice, a deflection surface on a downstream side of said discharge orifice for directing liquid discharging from said orifice in a direction transverse to the axis of said chamber, a second surface upstream of said deflection surface, and a pocket extending downstream of said deflection surface a distance greater than the diameter of said chamber, said spray tip having a metering orifice adjacent an upstream side of said chamber that is substantially smaller in diameter than the diameter of said chamber, and said cross slot being oriented at an angle of between about 45 degrees and 75 degrees to the axis of said chamber.

21. The spray nozzle assembly of claim 20 in which said deflection surface is disposed at an angle of about 45 degrees to the axis of said chamber and said second surface is disposed at an angle of about 75 degrees to the axis of said chamber.

22. A spray nozzle assembly comprising, stem means defining a passage through which a supply liquid is directed, a spray tip, means for mounting said spray tip on said stem means for receiving supply liquid from said passage and for directing the liquid in a pre-determined spray pattern, said spray tip being formed with an elongated, axially extending cylindrical chamber communicating with said passage, said spray tip being formed with a cross slot which intersects said chamber at a location intermediate opposite ends thereof for defining a discharge orifice, a deflection surface on a downstream side of said discharge orifice for directing liquid discharging from said orifice in a direction transverse to the axis of said chamber, a second surface disposed an upstream relation to said deflection surface, and a pocket extending downstream of said deflection surface, and a pocket extending downstream of said deflection surface, said spray tip having a metering orifice adjacent an upstream side of said chamber that is substantially smaller in diameter than the diameter of said chamber, and said deflection and upstream surfaces being connected by a round that extends at least to the axis of said chamber and which has a radius greater than the diameter of said chamber.

23. The spray nozzle assembly of claim 22 in which said round has a radius of about twice the diameter of said chamber.

24. The spray nozzle assembly of claim 23 in which said round extends beyond the axis of said chamber substantially to the perimeter to the chamber for defining a discharge orifice having an area at least as large as the cross sectional area of said chamber for permitting the free passage of liquid introduced into said chamber.

25. The spray nozzle assembly of claim 26 in which said spray tip is formed with a tapered entry throat at an upstream in thereof communicating between said stem means passage and said chamber.

26. The spray nozzle assembly of claim 23 in which said deflection surface is disposed at an angle of about 45 degrees to the axis of said chamber.

27. The spray nozzle assembly of claim 26 in which said second surface is disposed in substantially perpendicular relation to the axis of said chamber.

28. A spray nozzle assembly for mounting on a spray boom through which a supply liquid is directed comprising, a stem mounted on said boom and having a liquid passage for receiving supply liquid from said boom, a spray tip, means for mounting said spray tip on said stem for receiving supply liquid from said stem passage and for directing the liquid in a pre-determined spray pattern, said spray tip being formed with an elongated, axially extending cylindrical chamber communicating with said stem passage, and said spray tip being formed with a cross slot which intersects said chamber at a location intermediate opposite ends thereof for defining a discharge orifice, a deflection surface on a downstream side of said discharge orifice for directing liquid discharging from said orifice in a direction transverse to the axis of said chamber, and a pocket extending downstream of said deflection surface a distance corresponding to about three times the diameter of said chamber.

29. A spray nozzle assembly for mounting on a spray boom through which a supply liquid is directed comprising, a stem mounted in vertically depending relation to said boom and having a liquid passage for receiving supply liquid from said boom, a spray tip, means for mounting said spray tip on said stem for receiving supply liquid from said stem passage and for directing the liquid in a pre-determined spray pattern, said spray tip being formed with an elongated, cylindrical chamber communicating with said stem passage and oriented with its axis at an angle to the vertical, and said spray tip being formed with a cross slot extending substantially vertically upwardly into the underside of said spray tip and intersecting said chamber at a location intermediate opposite ends thereof for defining a discharge orifice, a deflection surface on a downstream side of said discharge orifice for directing liquid discharging from said orifice in a direction transverse to the axis of said chamber, and a pocket extending downstream of said deflection surface a distance greater than twice the diameter of said chamber.

30. A spray nozzle assembly for mounting on a spray boom through which a supply liquid is directed comprising, a stem mounted on said boom and having a liquid passage for receiving supply liquid from said boom, a spray tip, means for mounting said spray tip on said stem for receiving supply liquid from said stem passage and for directing the liquid in a pre-determined spray pattern, said spray tip being formed with an elongated, axially extending cylindrical chamber communicating with said stem passage, and said spray tip being formed with a cross slot which intersects said chamber at a location intermediate opposite ends thereof for defining a discharge orifice, a deflection surface on a downstream side of said discharge orifice for directing liquid discharging from said orifice in a direction transverse to the axis of said chamber, a second surface upstream of said deflector surface, and a pocket extending downstream of said deflection surface a distance greater than the diameter of said chamber, said spray tip having a metering orifice adjacent an upstream side of said chamber that is substantially smaller in diameter than the diameter of said chamber, and said deflection and upstream surface being connected by round that extends beyond the axis of said chamber substantially to the perimeter of chamber.

31. A spray nozzle assembly comprising, vertically disposed stem means having a liquid passage through which a supply liquid is directed, a spray tip, means for mounting said spray tip on a lower end of said stem means for receiving supply liquid from said liquid passage, said spray tip being formed with an elongated, cylindrical chamber communicating with said stem means passage and having an axis disposed at an angle of about 38° to the vertical, and said spray tip being formed with a substantially vertically oriented cross slot on the underside thereof which intersects said chamber at a location intermediate opposite ends thereof for defining a discharge orifice, a deflection surface on a downstream side of said discharge orifice for directing liquid discharging from said orifice in a downward direction, and a pocket extending downstream of said deflection surface.

* * * * *